United States Patent [19]

Ikeda et al.

[11] Patent Number: 5,000,098

[45] Date of Patent: Mar. 19, 1991

[54] COMBUSTION APPARATUS

[75] Inventors: Shiro Ikeda; Ken Hyodo; Satoshi Kawachi, all of Yokohama, Japan

[73] Assignee: JGC Corporation, Tokyo, Japan

[21] Appl. No.: 481,447

[22] Filed: Feb. 16, 1990

[30] Foreign Application Priority Data

| | | | |
|---|---|---|---|
| Feb. 16, 1989 | [JP] | Japan | 1-36734 |
| Jan. 22, 1990 | [JP] | Japan | 2-12026 |
| Jan. 22, 1990 | [JP] | Japan | 2-12026 |

[51] Int. Cl.[5] ..... F23G 7/04

[52] U.S. Cl. ..... 110/238; 110/203; 110/214; 110/235; 110/259; 110/264

[58] Field of Search ..... 110/264, 203, 214, 160, 110/161, 165 A, 235, 238, 259

[56] References Cited

U.S. PATENT DOCUMENTS

| | | | |
|---|---|---|---|
| 2,917,011 | 12/1959 | Korner | 110/165 A |
| 3,747,542 | 7/1973 | Ruohola et al. | 110/214 |
| 4,512,264 | 4/1985 | Crawford | 110/160 |
| 4,566,392 | 1/1986 | Ishihara | 110/264 X |
| 4,579,067 | 4/1986 | Peters | 110/264 X |
| 4,873,930 | 10/1989 | Egense et al. | 110/264 X |

*Primary Examiner*—Edward G. Favors

*Attorney, Agent, or Firm*—Scully, Scott Murphy & Presser

[57] ABSTRACT

The present invention relates to combustion devices such as incineration furnaces and the like, and in particular, relates to combustion devices which include a combustion gas cooling device by means of which slag, combustion by-products and the like are rapidly cooled and thereby converted to nonadhering fly ash. By converting slag to nonadhering fly ash, the accumulation of slag in downstream exhaust processing equipment is diminished, and hence, the necessity of halting the operation of the combustion apparatus in order to remove the accumulated slag is eliminated, thereby improving the efficiency of operations.

18 Claims, 6 Drawing Sheets

210
220
230
240
241
242
243
244
247
248
250
251
251a
252
252a
252b
253
254
260
261
262
263
264
221
222
223
224
225
226
231
232
233
234
234A
235
236
BA1
BA2
BA3
BA4
BA5
BA6
BA7
BB1
BB2
BB3
BB4
BC1
BE1
BE2
BF1
BF2
II
III

COMBUSTION APPARATUS

BACKGROUND OF THE INVENTION

1. Field of the Invention

The apparatus of the present invention relates to combustion devices such as incineration furnaces and the like, and in particular, relates to a combustion-gas cooling device which is mounted on the combustion device wherein dust form slag is generated. More particularly, the apparatus of the present invention relates to a combustion device that combusts or otherwise heats material at a high temperature so that ash components therein liquify, and in which fumes and fine particles of liquified ash entrained in the combustion gasses formed therein are converted to fly ash which is nonadhering to surfaces of the combustion-gas exhausting section.

2. Prior Art

Slag is a material composed of various noncombustible substances remaining after combustion takes place at a temperature greater than the melting point of the slag. Slag can usually exist in three general states: at low temperatures, slag is a nonadherent solid; at medium temperatures, slag is a highly viscous liquid which is relatively adhering and nonflowing; and at high temperatures, slag is a fluid of low viscosity which may or may not adhere, but which flows readily.

As an example of a prior art combustion apparatus, the combustion apparatus 10 shown in FIG. 6, is known in which a cyclone-type combustion furnace 20 contains a combustion chamber 22 for receiving particles which are to be combusted. After the particles are combusted, the remnants are carried by centrifugal force around the face of the inner wall, adhere to the inner wall, and are heated to liquefaction, resulting in combustion gas and slag. Therefore, unburned components are exhausted from exhaust port 26. The slag separation pathway 34 in the slag separation chamber 30 at the combustion gas inlet 33 mediates the supply, and the slag is removed by passing out through the exhaust port 26; the greater part of the slag flows down the inner wall of the combustion chamber, flows down the inner wall of the exhaust port 26 as combustion gas is exhausted from combustion gas chamber 22, and passes down slag separation pathway 34 in slag separation chamber 30 at combustion gas inlet 33 of slag separation chamber 30, while a smaller portion of the slag is carried out as particles or droplets suspended in the moving combustion gas.

Along the slag separation path 34 in slag separation chamber 30, combustion gas exhausted from combustion gas inlet 33 is separated from the slag. The combustion gas is then exhausted through exhaust port 35 and is then supplied to a treatment apparatus (for example heat recovery apparatus 50) for final exhaustion to the outside, while the thus separated slag is expelled to a treatment apparatus at slag outlet 36.

At the exhaust port 35, in order that the subsequent treatment apparatus is supplied with combustion gas of a temperature low enough not to damage the treatment apparatus, and in order that slag is converted into nonadhering fly ash, low temperature gas is supplied to be mixed with the combustion gas to produce a mixture of a suitably low temperature downstream of the mixing site, by low temperature gas supply pipe 35A; the high temperature of the combustion gas (for example 1300°–1500° C.) is reduced to below 1000° C.

If the high temperature combustion gas in which slag is suspended is allowed to proceed past exhaust port 35, and if the slag suspended in the combustion gas subsequently encounters a low temperature surface, it is transformed to a highly viscous or solid state and will adhere to and accumulate on the surface, and accordingly, a great deal of labor will have to be expended to remove the accumulated slag.

Therefore, in combustion apparatus 10, suitably low temperature gas is supplied directly from the low temperature gas supply pipe 35A to the interior of exhaust port 35, however it is not possible to mix high temperature combustion gas and low temperature gas sufficiently rapidly and homogeneously, and it is not possible to avoid the production of an adhering ash fraction and the restriction of flow in the low temperature gas supply pipe 35A and combustion gas exhaust port 35 by the rapid accumulation of adhering slag downstream of the opening of the low temperature gas supply pipe 35A and exhaust port 35, which requires intermittent cessation of operation of the combustion apparatus, since the formation of the adhering slag necessitates removal. The invention is directed toward overcoming these problems.

SUMMARY OF THE INVENTION

It is therefore an object of the present invention to provide a combustion apparatus which includes a combustion gas cooling device attached to the combustion apparatus to cool slag particles to a nonadhering state.

In the combustion apparatus of the present invention, a combustion furnace is provided for combusting materials at high temperatures to melt ash components and thereby generate combustion gas and slag, which is then led into a slag separation chamber or slag separation furnace in which combustion gas and slag are separated from each other, and combustion gas is exhausted from the combustion gas exhaust port from the slag separation chamber or the slag separation furnace. Low temperature gas from a low temperature gas supply pipe is supplied to the combustion gas exhaust port to cool the combustion gas from the combustion apparatus.

At the combustion gas exhaust port, the following are provided in the attached cooling device:

(a) a casing of which one end opens to the combustion gas exhaust port and the other end is provided with openings for the low temperature gas supply pipe;

(b) a duct made of material having good heat conductivity provided in the casing so that a space is formed between the inner surface of the casing and the duct as a pathway for low temperature gas, and openings are provided for a low temperature gas pathway at one end of the duct;

(c) another opening near the other end of the duct for exhaustion of combustion gas cooled by mixing of the low temperature gas.

In the operation of the examples of the combustion apparatus of the present invention, material to be combusted is received in the combustion furnace and is heated to liquefaction and combustion, and generates combustion gas and slag which then pass to a slag separation chamber where combustion gas and slag are separated from each other. Combustion gas from the slag separation chamber is exhausted from the combustion gas exhaust port, and led to the combustion gas cooling device of the present invention.

In the combustion gas cooling device of the present invention, the droplets of liquefied slag, suspended originally in the high temperature combustion gas, are cooled by the homogeneous mixture of combustion gas and low temperature gas which is at a temperature below the melting temperature of the slag, while the droplets of slag continue to be suspended by moving gas. The droplets which contact the inner surface of the duct are instantaneously cooled and solidified and become nonadherent since the temperature of the surface of the duct is sufficiently low. This is in contrast to the prior art apparatus in which accumulation of adhering slag in the downstream opening of the low temperature gas supply pipe restricts the flow of the low temperature gas and combustion gas.

DETAILED DESCRIPTION OF THE PREFERRED EMBODIMENTS

Next, the combustion apparatus of the present invention will be specifically explained, followed by examples. While the following descriptions of the preferred embodiments are given to facilitate understanding of the present invention, it should be understood that these descriptions do not limit the scope of the invention.

Figure 1:
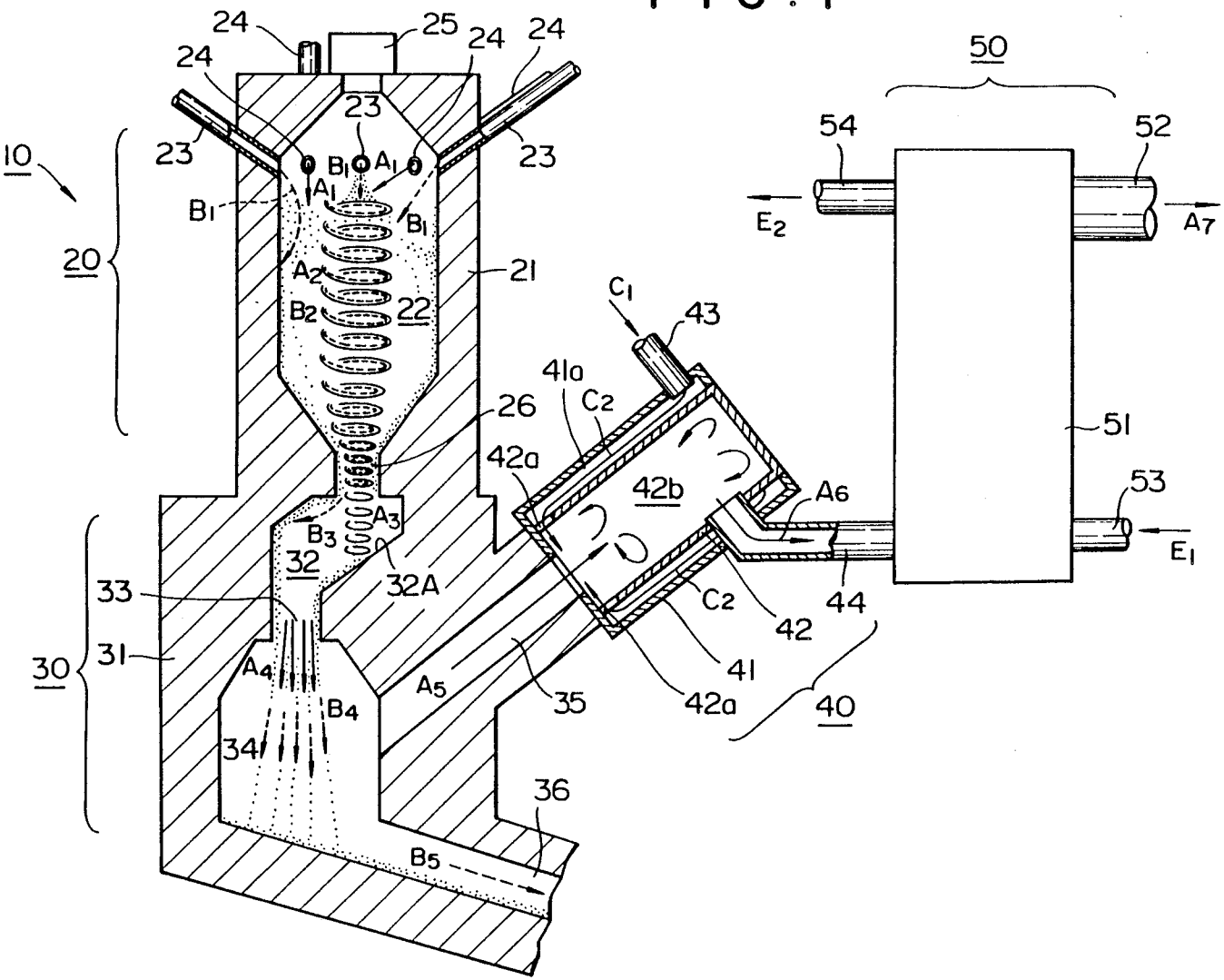
FIG. 1 is a partial vertical cross section through the combustion furnace, the combustion gas cooling device, and the heat recovery apparatus of the first example of an embodiment of the present invention.
Figure 2:
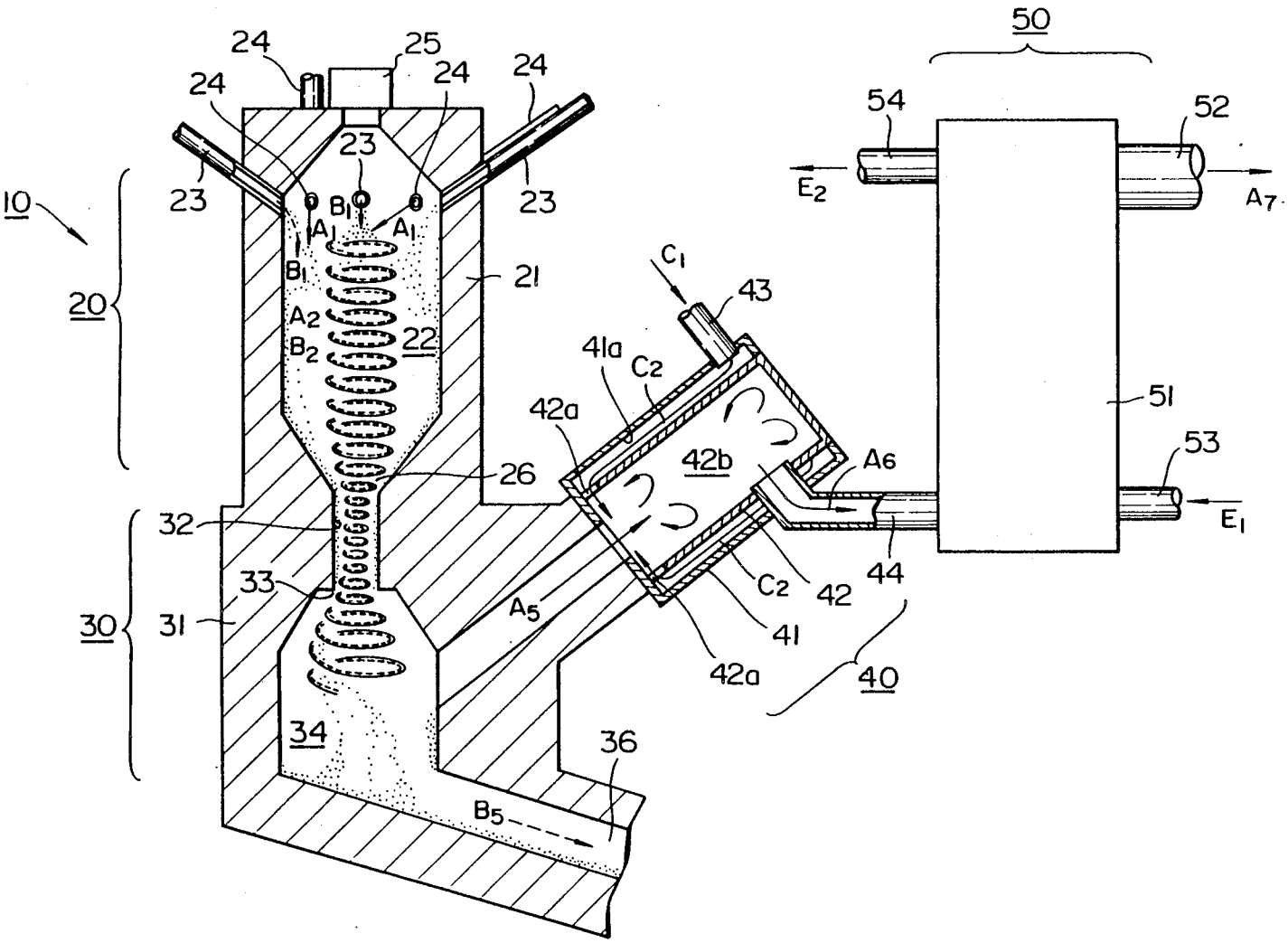
FIG. 2 is a partial vertical cross section through the combustion furnace, the combustion gas cooling device, and the heat recovery apparatus of the second example of an embodiment of the present invention.
Figure 3:
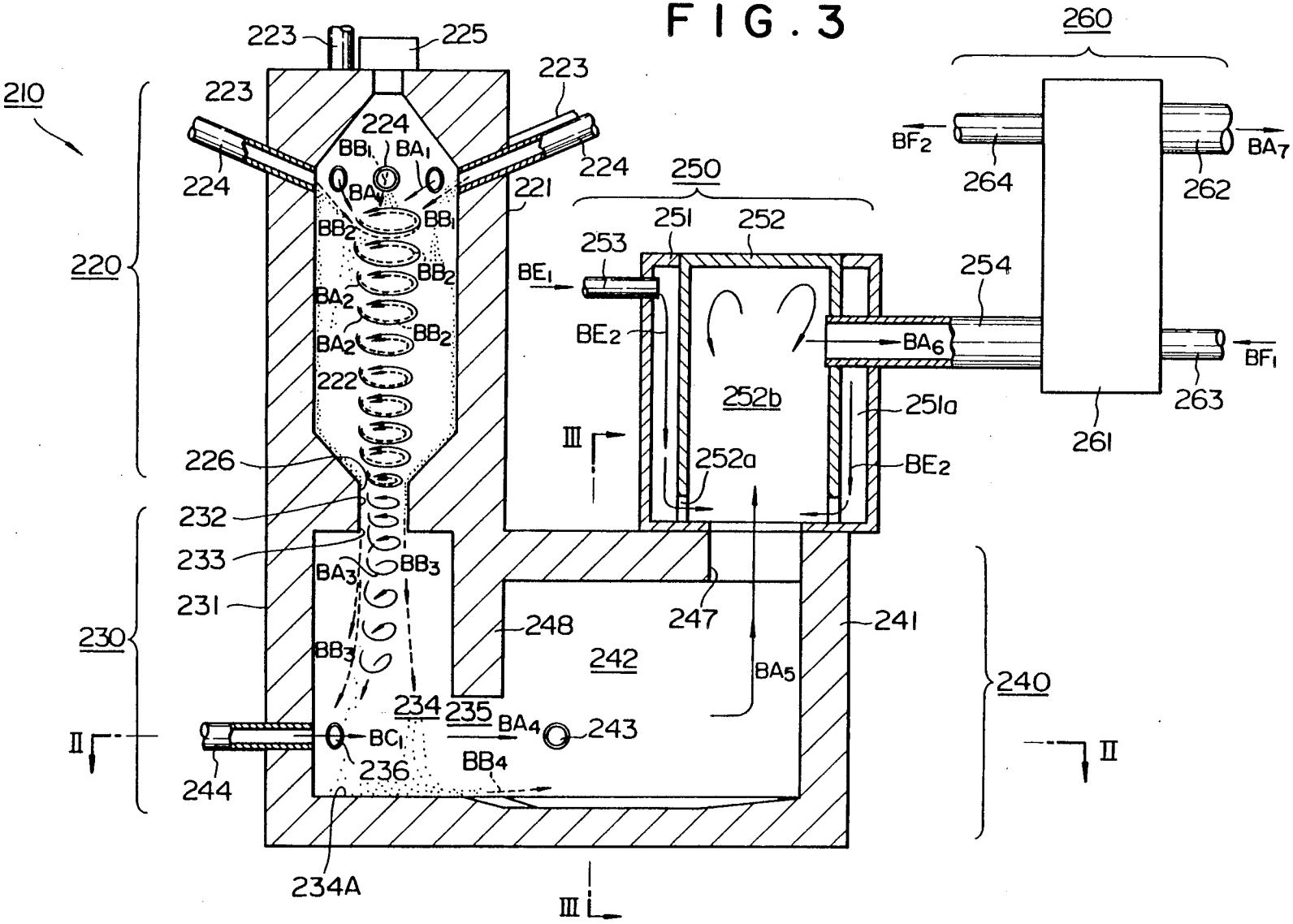
FIG. 3 is a partial vertical cross section through the combustion furnace, the combustion gas cooling device, and the heat recovery apparatus of the third example of an embodiment of the present invention.

As shown in FIGS. 1, 2, and 3, the combustion gas cooling device 40 comprises cylindrical casing 41, cylindrical duct 42, and low temperature gas supply pipe 43. One end of cylindrical casing 41 communicates with one opening of the exhaust port 35. Adjacent to the exhaust port 35, the duct has at least one opening which introduces the low temperature gas to the inner space of the duct from the low temperature gas pathway.

Near one end of cylindrical casing 41, low temperature gas supply pipe 43 is provided to supply low temperature gas to the low temperature gas pathway 41*a* which is formed between the outer face of cylindrical duct 42 and the inner circumferential face of cylindrical casing 41. At another part of the cylindrical duct 42, the cooled combustion gas is directed to the outside by the combustion gas exit duct 44.

In order to avoid collision of high temperature gas with the inside wall of the duct, it is desirable that the inner diameter of the duct is larger than that of the combustion gas exhaust port and that the longitudinal axis of cylindrical duct 42 be parallel to the axis of the combustion gas exhaust port.

It is also desirable to use steam, flue gas or air of between 150° and 250° C. as the low temperature gas which is supplied through low temperature gas pathway 41*a* and one or more openings 252*a*, to the inner air space 42*b* of cylindrical duct 42.

Combustion gas cooling device 40 is supplied with low temperature gas by low temperature gas supply pipe 43 (shown by arrow C1) which passes through the low temperature gas pathway 41*a* and cools the metal duct 42. Low temperature gas in the low temperature gas pathway 41*a* flows in the direction shown by arrow C2. The low temperature gas is then exhausted to the interior air space 42*b* of the cylindrical duct from the one or more openings 252*a*. To the inner air space 42*b* of cylindrical duct 42, low temperature gas (shown by arrow C2) is supplied, and combustion gas (shown by arrow A5) is supplied from the exhaust port 35. The combustion gas and the low temperature gas are rapidly mixed and rapidly cooled to below 1000° C.

The temperature of the homogeneous mixture of combustion gas and low temperature gas may be controlled by, for example, adjusting the rate of supply of the low temperature gas to the interior of the combustion gas cooling device 40.

The minute particles of slag are rapidly converted into non-adhering fly ash, and the inner circumferential surface of cylindrical duct 42 is cooled by low temperature gas so that slag particles do not adhere to the inner circumferential surface of cylindrical duct 42. In the inner space 42*b* of the cylindrical duct 42, particulate slag in the combustion gas is converted into fly ash to be exhausted.

In FIG. 1, the first example of a combustion apparatus with the combustion gas cooling device of the present invention is shown. The exhaust port 26 of the cyclone-type combustion furnace communicates with the introduction passage 32 in the slag separation chamber 30 so that materials in the cyclone will collide with contact surface 32A.

In FIG. 2, a second example of a combustion apparatus with the combustion gas cooling device of the present invention is shown in partial vertical cross section. The combustion gas exhaust port 26 of the cyclone-type combustion furnace 20 communicates with the introduction passage 32 in the slag separation chamber 30 so that materials in the cyclone will be carried further along the introduction passage 32.

In FIG. 3, a third example of a combustion apparatus with the combustion gas cooling device of the present invention is shown in partial vertical cross section. The third example differs in part from the first and second examples in that the combustion gas cooling device is disposed vertically instead of horizontally, and in that the furnace is provided with a contact surface and a secondary combustion furnace, among other features. These examples will be described in greater detail hereinafter.

First, with reference to FIG. 1, elements comprising the example, the operation thereof, and details and particulars of the first example of the combustion apparatus of the present invention will be explained. For the sake of convenience, the cyclone-type combustion furnace 20 is shown by way of illustration; however, the present invention is not limited to the use of this cyclone-type combustion furnace, and other types of combustion furnaces may also be used.

The combustion apparatus 10 of the present invention is equipped with cyclone-type combustion furnace 20. Below the cyclone-type combustion furnace 20, slag separation chamber 30 is disposed. Communicating with the slag separation chamber 30 the combustion gas cooling device 40 is disposed. The combustion gas cooling device 40 cools combustion gas for the subsequent treatment apparatus (for example, a.heat recovery apparatus 50 to collect heat from the combustion gas, explained hereinafter).

In the cyclone-type combustion furnace 20, a cylindrical passage 22 (not limited to being cylindrical; the cross section could be polygonal, for example hexagonal) is formed and to this cylindrical passage, combustion air is supplied from at least one (for example, four) air supply pipe 23. Material to be combusted and/or heated such as dried sludge, pulverized coal, incineration ash, etc., are fed to the interior of combustion chamber 22 by at least one (for example, four) supply pipe 24. At the top of furnace body 21, in the combustion chamber 22, combustion initiation burner 25 is provided for the initiation of combustion; while at the lower part of the combustion chamber 22 exhaust port 26 is formed to exhaust combustion gas, slag and combustion ash from the combustion chamber 22.

Slag separation chamber 30 comprises introduction passage 32, slag separation space 34, exhaust port 35, and slag outlet 36. Introduction passage 32 at the exhaust port 26 of the cyclone-type combustion furnace 20 passes flue gas, slag and ash for exhaustion to the outside. In slag separation space 34, combustion gas and slag are separated from each another. Exhaust port 35 opens at one end to the slag separation chamber and at the other end continues on to the heat recovery apparatus 50, via the combustion gas cooling device 40 through which passes combustion gas to be exhausted from said exhaust port 35. Slag outlet 36 opens at one end to the lower part of the slag separation space 34 and continues on to the slag treatment apparatus.

The introduction passage 32 is winding and curves. Combustion gas is exhausted from the exhaust port 26 of cyclone-type combustion furnace 20, and collides with the contact surface 32A to weaken and flow cyclically and cause it to die out, leaving the slag and the fly ash carried by the combustion gas to be captured and collected.

The combustion gas cooling device 40 comprises cylindrical casing 41, cylindrical duct 42, and low temperature gas supply pipe 43. One end of cylindrical casing 41 communicates with one opening of the exhaust port 35.

The cylindrical duct 42 has at least one opening adjacent to the opening of exhaust port 35 for introduction of low temperature gas into the inner space of the duct.

Near the other end of cylindrical casing 41, low temperature gas supply pipe 43 is provided to supply low temperature gas to the low temperature gas pathway **41*a* formed between the outer face of cylindrical duct 42 and the inner face of cylindrical casing 41. At the other end of the cylindrical duct 42, the cooled combustion gas is directed to the outside by the combustion gas exit duct 44**.

In the cylindrical duct 42, in order to avoid collision of high temperature gas with the inside wall of the duct, it is desirable that the inner diameter of the duct be larger than that of the combustion gas exhaust port and that the longitudinal axis of cylindrical duct 42 be parallel to the axis of the combustion gas exhaust port.

It is desirable to use steam, flue gas or air of between 150° and 250° C. as the low temperature gas which is supplied through low temperature gas pathway **41*a* and one or more openings 252*a*, to the inner air space 42*b* of cylindrical duct 42**.

Heat recovery apparatus 50 comprises heat recovery apparatus body 51, gas exhaust port 52, and air supply pipe 53. Heat recovery apparatus body 51 receives combustion gas having a temperature below 1000° C. Heat recovery apparatus body 51 communicates with the other end of the combustion gas exit duct 44. The gas exhaust port 52 is for the exhaustion of the combustion gas from which heat has been recovered in the heat recovery apparatus 50 to a subsequent combustion gas treatment apparatus (for example, a sulfur oxide removing apparatus). Air supply pipe 53 supplies outside air to the heat recovery apparatus body 51. Heat-exchanged air (that is, heated air) from the heat recovery apparatus body 51, is exhausted by air exhaust pipe 54 and is supplied to air supply pipe 23.

With reference to FIG. 1, the operation of the first example of the present invention will be explained hereinafter in detail.

At the cyclone-type combustion furnace, air supply pipe 23 conveys air used for combustion to the interior of combustion chamber 22 in furnace body 21, shown by solid arrow A1. Solid arrow A2 shows the axis of formation of the cyclone flow in the combustion chamber of the furnace body 21.

Material to be combusted is supplied through supply pipe 24 conveyed by air (shown by broken arrow B1) to the cyclone flow in the central part of the combustion chamber 22 of the combustion furnace body 21. The material to be combusted is scattered by vortex motion over a wide area of the inside surface of the combustion chamber.

Combustion of material is initiated at one time by the combustion initiation burner 25 in the combustion chamber 22. Combustion then continues along the inner wall and in the inner space of combustion chamber 22 and the temperature inside the combustion chamber is kept above the melting point of ash of the material fed to the combustion chamber. Combustion gas and melted ash (slag) are carried by the cyclone (shown by arrow A3) and are exhausted from exhaust port 26. The liquefied slag is carried along the inner wall of combustion chamber 22 by the centrifugal force of the cyclone-type (shown by broken arrow B3) and, with the combustion gas, is exhausted from exhaust port 26 (shown by solid arrow A3).

However, although the cyclone flow (as shown by solid arrow A3) is maintained along the combustion gas pathway in the slag separation chamber 30, the cyclone weakens when it collides with contact surface 32A. The melted ash conveyed by the combustion gas from the combustion chamber 22 collides with contact surface 32A and is scattered in the interior air space of introduction passage 32. After colliding with the inner wall along the introduction passage 32 and the contact surface 32A, the slag flows downward to be collected. Moreover, as the cyclone flow substantially weakens and ceases, the slag is substantially separated from the combustion gas. The other end of the introduction passage 32, that is, the combustion gas inlet shown by solid arrow A4, allows the combustion gas to be exhausted toward the slag separation space 34 in the slag separation chamber 30. Similarly, slag flows down the inner walls along introduction passage 32, and at the other end, that is, at combustion gas inlet B4 shown by broken arrow 33, trickles down toward the slag separation space 34. The cyclone of combustion gas is substantially and sufficiently weakened so that slag falls, and does not scatter toward the inner walls of slag separation space 34, and directly drops toward the floor of the slag separation space 34.

In the slag separation space 34 of the slag separation chamber 30, high temperature (for example, 1300°-1500° C.) combustion gas is exhausted from exhaust port 35 in the direction (shown by arrow A5) of the subsequent combustion gas cooling device 40. Slag is also expelled in the direction (shown by the broken arrow B5) of the subsequent treatment apparatus from the slag outlet 36 formed in the lower part of the slag separation chamber 30.

Combustion gas cooling device 40 is supplied with low temperature gas by low temperature gas supply pipe 43 (shown by arrow C1) which passes through the low temperature gas pathway 41*a* formed between the cylindrical casing 41 and the cylindrical duct 42. Low temperature gas in the low temperature gas pathway 41*a* flows in the direction shown by arrow C2. In cylindrical duct 42, slag particles are converted to nonadherent solid particles through rapid cooling by mixing of the low temperature gas which is introduced into the interior space 42*b* of the cylindrical duct from the one or more openings 252*a*. Low temperature gas passing outside the cylindrical duct 42 cools the surface of the duct so that the slag particles which contact the duct surface are instantaneously cooled and become nonadhering.

The temperature of the homogeneous mixture of combustion gas and low temperature gas may be controlled by, for example, adjusting the rates of supply of the low temperature gas to the interior of the combustion gas cooling device 40.

The nonadhering particles which are converted from slag particles in the cylindrical duct are exhausted entrained by the combustion gas and are later captured, for example by electric precipitation.

Next, with reference to FIG. 2, elements which comprise the second example of the combustion apparatus of the present invention, and the use thereof, will be explained.

In the second example, the contact surface 32A of the introduction passage 32 is not provided, however, the combustion apparatus is otherwise similar to that in the first example. In other words, the second example is the same as the first example except that the contact surface 32A of the combustion gas pathway is lacking, and therefore in the cyclone-type combustion furnace 20, exhaust port 26 leads directly downwards through a tubular path to the combustion gas inlet 33 in the slag separation chamber 30 to supply combustion gas (as shown, for example, in FIG. 2). Since the second example is substantially the same as the first example shown in FIG. 1, descriptions of like parts which are numbered the same are omitted.

The above-mentioned explanation of the supply of combustion air at the slag separation chamber 30 is not a limitation of the present invention but includes the case in which it is desirable that combustion continues at the supply of combustion air at the slag separation chamber 30. That is, the present invention includes the case in which the slag separation chamber 30 has, in addition to the slag separating function, the function of a secondary combustion furnace.

In addition, to further elaborate on an example of the combustion apparatus of the present invention, a preferred usage example in which dried particles from sewage sludge are heated and melted by the cyclone-type combustion furnace 20 shown in FIG. 2, will be described hereinafter citing concrete data. The fraction of ash components in the dried particles was 30-50% by weight, and the melting temperature of the particles of ash was 1100° to 1200° C., and the flowing temperature of melted ash was 1150° to 1250° C.

Figure 4:
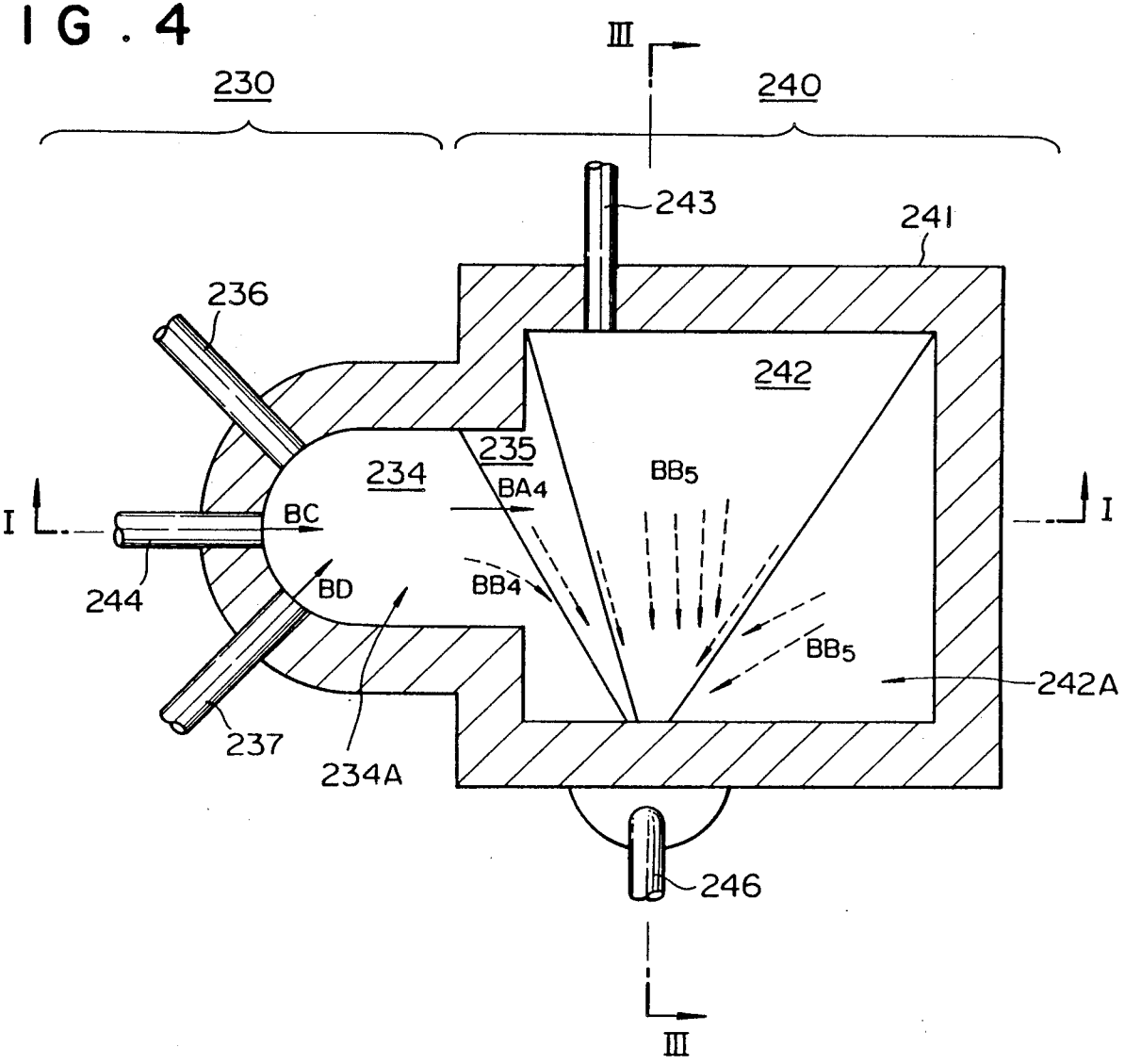
FIG. 4 is a horizontal section of the apparatus shown in FIG. 3, through the line II—II.
Figure 5:
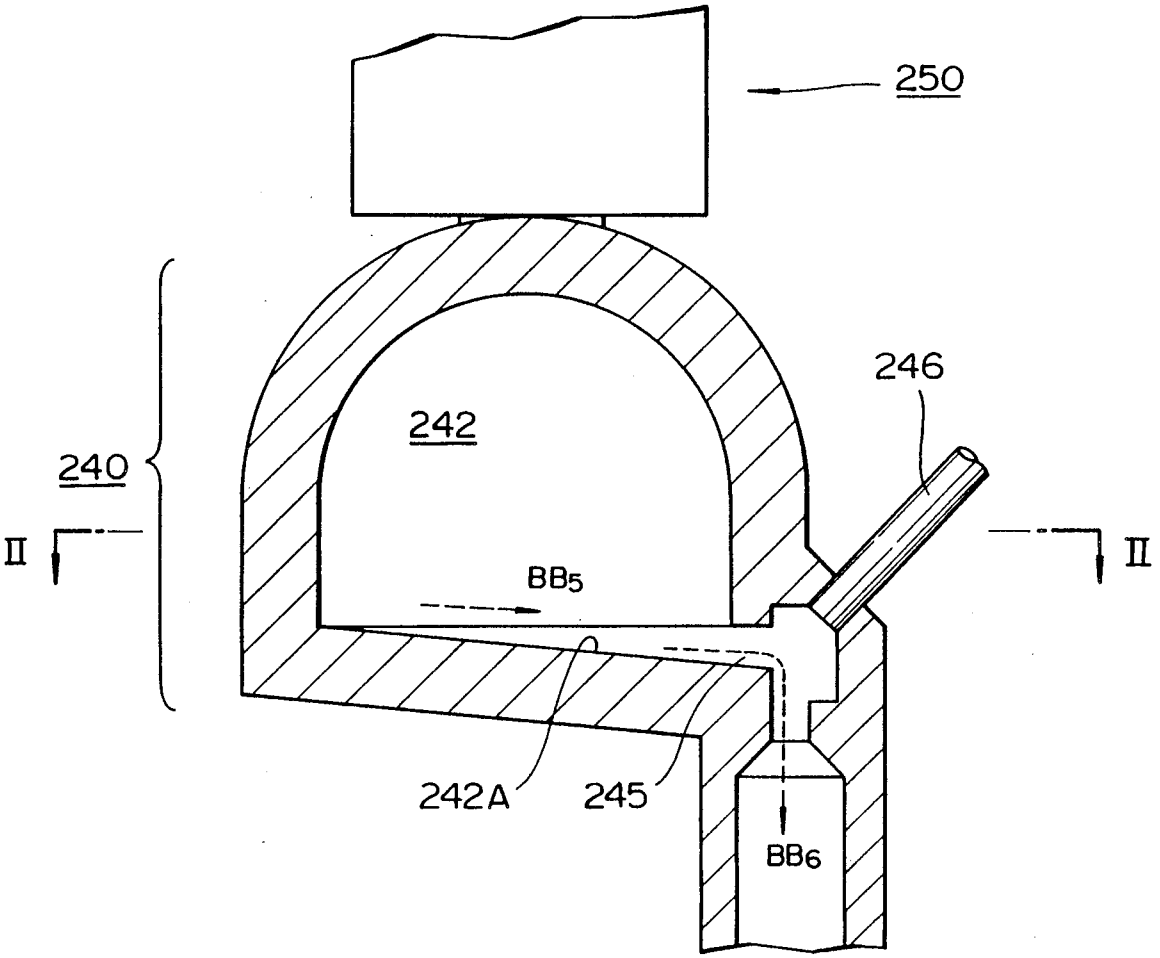
FIG. 5. is a vertical section of the apparatus shown in FIG. 3, through the line III—III.
Figure 6:
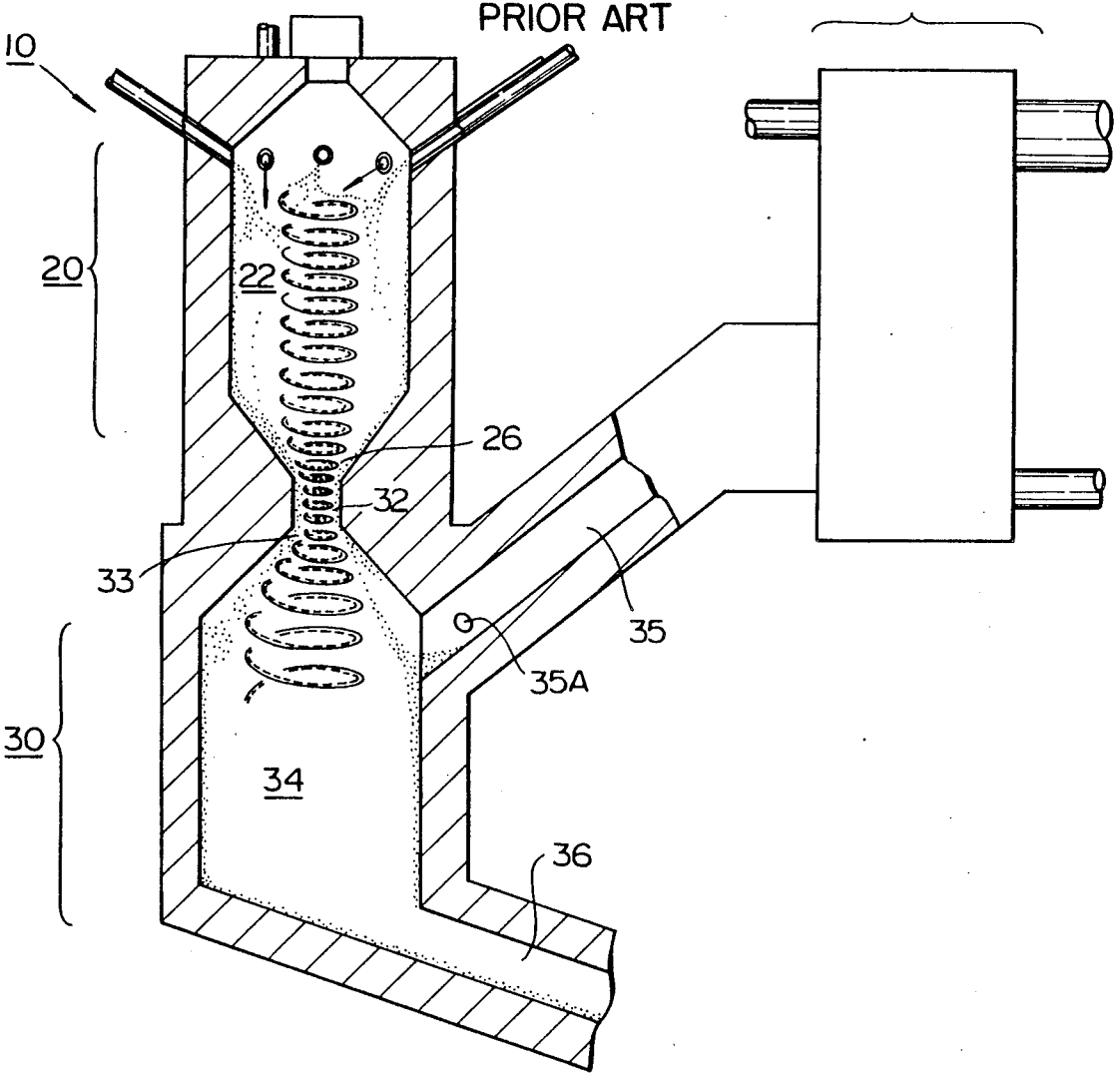
FIG. 6 PRIOR ART
FIG. 6 is a partial vertical cross section through an example of a conventional combustion apparatus.

In the following section, a third example of the present invention will be described with reference to FIGS. 3 to 5.

In FIG. 3, a vertical cross section view of the combustion apparatus 210 of the present example is shown. The combustion apparatus 210 successively comprises a cyclone-type combustion furnace 220, a slag separation chamber 230 which connects with the lower end of the above mentioned cyclone-type combustion furnace 220, a secondary combustion furnace 240 which is in lateral continuity with the above-mentioned slag separation chamber 230, as well as a combustion gas cooling device 250 which is in continuity with the superior aspect of the above-mentioned secondary combustion furnace 240. The suspension of liquified particles of slag and combustion gas (primary combustion gas) formed in the cyclone-type combustion furnace 220 travels to the slag separation chamber 230 where the slag and combustion gas are separated from each other. In the secondary combustion furnace 240 following the slag separation chamber 230, combustible material which remains in the combustion gas is subjected to a secondary combustion process, and the secondary combustion gas thereby formed, which includes the above-mentioned primary combustion gas, is then exhausted to the combustion gas cooling device 250. In the combustion gas cooling device 250, minute particles of slag suspended in the secondary combustion gas are rapidly cooled and thereby converted to nonadherent fly ash. The cooled secondary combustion gas from the above-mentioned combustion gas cooling device 250 is then exhausted to the following combustion gas processing equipment (for example, the heat recovery apparatus 260 to be described below) where it is appropriately processed.

The above-mentioned cyclone-type combustion furnace 220 has a furnace body 221 which is, for example, of a circular or polygonal cross section of, for example, six or more sides, and includes one or more (for example 4) combustion air supply pipes 223 which supply the air required for combustion (primary air) to the combustion chamber 222, one or more (for example 4) particulate matter supply pipes 224 which supply material to be combusted (for example dried sludge, coal particles) with a conveyor gas (usually heated air) to the combustion chamber 222, an auxiliary burner 225 at the top of combustion chamber 222 for initiating combustion or for increasing the temperature in combustion chamber 222, and an exhaust port 226 for exhausting the above-mentioned primary combustion gas to the slag separation chamber 230.

One end of the above-mentioned slag separation chamber 230 is open, thereby forming an introduction port 233, and via an introduction passage 232, connects with the exhaust port 226 of cyclone-type combustion furnace 220 above, with which it is in a generally vertical relationship. Thus, exhausted primary combustion gas and suspended slag leaving the cyclone-type combustion furnace 220 via exhaust port 226 then enters slag separation chamber 230, passing successively through introduction passage 232 and introduction port 233. Leaving introduction port 233, exhausted primary combustion gas and suspended slag is directed downward into the slag separation space 234 of slag separation chamber 230 where it comes into contact with an expanded contact floor 234A with which the stream of combustion gas and slag is generally in a perpendicular relationship. As the stream of primary combustion gas and suspended slag comes into contact with the contact floor 234A, the suspended minute particles of slag aggregate with liquified slag which has already accumulated (slag flow) on the contact floor 234A, whereby the slag is separated from the primary combustion gas. The slag separation chamber 230 includes an exhaust port 235 which provides a horizontal elongated connection with the slag separation chamber 230 and secondary combustion furnace 240, whereby primary combustion gas and the above-mentioned slag flow are exhausted from the slag separation chamber 230 to the secondary combustion furnace 240. One or more auxiliary burners 236 are provided in the slag separation chamber 230 for heating the primary combustion gas when it has cooled excessively. Also, one or more cooling gas supply pipes 237 (see FIG. 4) are provided which open into the slag separation chamber 230 to provide cooling gas (ordinarily consisting of exhausted combustion gas), whereby primary combustion gas which is too hot can be cooled.

The secondary combustion furnace 240 consists of a secondary combustion chamber 242 which is formed in a secondary combustion furnace body 241. One or more auxiliary burners 243 are provided in the secondary combustion chamber 242 for heating the space therein when it has cooled excessively. One or more air supply pipes 244 are provided which open into the slag separation space 234 whereby air (secondary combustion air) is provided. The inclined floor 242A (see FIG. 4) of the secondary combustion chamber 242 is continuous with the previously mentioned contact floor 234A, and is open at its lowest portion, thereby forming a slag flow exit port 245 (see FIG. 5). An auxiliary burner 246 (see FIG. 4) is provided at the above-mentioned slag flow exit port 245 to heat the liquified slag flow. At its uppermost portion, the secondary combustion chamber 242 is open, thereby forming a secondary combustion gas port 247 through which the secondary combustion gas formed in the secondary combustion chamber 242 is introduced to the above-mentioned combustion gas cooling device 250. Between the secondary combustion chamber 242 and slag separation space 234, a vertical wall 248 is formed to permit the exhausted primary combustion gas and slag suspended therein from introduction port 233 to be more effectively directed downward into the slag separation space 234 so as to come into contact with the contact floor 234A.

The above-mentioned combustion gas cooling device 250 has a cylindrical casing 251 which communicates at one end with the previously mentioned secondary combustion gas port 247 of secondary combustion furnace 240, whereby the combustion gas cooling device 250 receives the secondary combustion gas. Within and coaxial to the above-mentioned cylindrical casing 251, a cylindrical duct 252 constructed of a metal having good thermal conduction properties is provided, thereby forming a low temperature gas introduction space **251*a*. One or more openings 252*a* are provided in the cylindrical duct 252 proximal to the secondary combustion gas port 247, whereby the above-mentioned low temperature gas introduction space 251*a* communicates with the central internal space 252*b* of the combustion gas cooling device 250. A low temperature gas supply pipe 253 is provided at the end of cylindrical casing 251 opposite secondary combustion gas port 247, whereby low temperature gas is supplied to the above-mentioned low temperature gas introduction space 251*a*. Also, a combustion gas exhaust port 254 is provided at the end of cylindrical duct 252 opposite secondary combustion gas port 247, whereby the cooled secondary combustion gas can leave the combustion gas cooling device 250**.

The above-mentioned cylindrical duct 252 ideally has an internal diameter larger than the diameter of the above-mentioned secondary combustion gas port 247 so that the minute particles of slag remaining in the secondary combustion gas can be prevented from colliding with the internal wall of the cylindrical duct 252 after they exit the secondary combustion gas port 247. For the same reason, it is desirable that the central longitudinal axis (the vertical axis in the present example) of the combustion gas cooling device 250 be parallel to and generally coaxial with the central longitudinal axis of the secondary combustion gas port 247. For the low temperature gas which is supplied via the low temperature gas supply pipe 253 to the low temperature gas introduction space **251*a*, and thence to the central internal space 252*b* via the one or more openings 252*a***, exhaust gas, steam or air at a temperature of 150° to 250° C. is ideally used.

The above-mentioned heat recovery apparatus 260 connected with the distal end of the combustion gas exhaust port 254 includes a heat recovery apparatus body 261 for receiving the secondary combustion gas which has been cooled to 1000° C. or lower. Also included is an air supply pipe 263 for supplying air to the heat recovery apparatus body 261 and an exhaust pipe 262 whereby after undergoing heat exchange in the heat recovery apparatus 260, the secondary combustion gas is sent on to further processing equipment (for example, a sulphur oxide scrubber, not shown in the drawings). After undergoing heat exchange in the heat recovery apparatus 260 (and hence heated), the air which was supplied by the above-mentioned air supply pipe 263 is exhausted and thereby sent on to the previously mentioned air supply pipe 223, and the like, via an air exhaust pipe 264.

In the following section, the operation of the above-described third example of the present invention will be discussed with reference to FIGS. 3 through 5.

As shown by the solid line and arrow $BA_1$ in FIG. 3, air required for combustion (primary air) is supplied to combustion chamber 222 of cyclone-type combustion furnace 220 via the one or more (for example 4) combustion air supply pipes 223. The thus supplied combustion air is then caused to travel downward in a cyclone-shaped path surrounding the central axis of symmetry of the cyclone-type combustion furnace 220, as shown by the solid line and arrow $BA_2$ in FIG. 3.

Further, as shown by the broken line and arrow $BB_1$, via the one or more (for example 4) particulate matter supply pipes 224, particulate combustible material conveyed by heated air, or the like, is fed into the above-described cyclone of combustion air formed within combustion chamber 222, and widely scattered therein as shown by the broken line and arrow $BB_2$.

Thus discharged within combustion chamber 222, particulate combustible material is maintained at the desired temperature through the operation of the previously described auxiliary burner 225, whereby within the combustion chamber 222 and in contact with its internal surface, the particulate combustible material is continuously incinerated and liquified. In this way, of the particulate combustible material which is actually combusted in the combustion chamber 222, one portion becomes primary combustion gas and the rest is transformed into liquified slag. Of the particulate combustible material which is not completely combusted in the combustion chamber 222, one portion becomes suspended, floating in the primary combustion gas, while the remainder aggregates with the liquified slag formed as mentioned above. Riding the above-described cyclone, as shown by the solid line and arrow $BA_3$ in FIG. 3, the primary combustion gas exits the combustion chamber 222 via exhaust port 226. As for the slag, one portion is carried by virtue of the centrifugal force of the cyclone and deposited on the internal wall of the combustion chamber 222, to which it adheres, and travels downward therealong. The remainder of the slag is in the form of minute particles traveling with the primary combustion gas, with which it exits the combustion chamber 222 via exhaust port 226 as shown by broken line and arrow $BB_3$ in FIG. 3.

From exhaust port 226, the primary combustion gas passes through the introduction passage 232 and introduction port 233 and is directed downward into the slag separation space 234 of slag separation chamber 230, continuing in a cyclone as shown by the solid line and arrow $BA_3$ in FIG. 3, while gradually decreasing in strength.

The greatest portion of the slag discharged through exhaust port 226 passes downward along the side wall of introduction passage 232 as shown by broken line and arrow $BB_3$ in FIG. 3, after which it trickles into the slag separation space 234 of slag separation chamber 230. The remainder of the slag travels suspended in the primary combustion gas, as described above, in the form of minute particles.

After entering the slag separation space 234 of slag separation chamber 230, traveling with the secondary combustion air as it exits from the one or more air supply pipes 244 as shown by the solid line and arrow $BC_1$, the high temperature (for example 1300° to 1500° C.) primary combustion gas is exhausted into the secondary combustion furnace 240 through exhaust port 235 as shown by the solid line and arrow $BA_4$. At the same time, the slag flows along the lower surface of exhaust port 235 and into the secondary combustion furnace 240 as shown by the broken line and arrow $BB_4$. When the primary combustion gas has been excessively cooled, the one or more auxiliary burners 236 are used to heat it to the appropriate temperature. When the primary combustion gas has been excessively heated, low temperature air is supplied from the one or more air supply pipes 237 as shown by the solid line and arrow BD to cool it to the appropriate temperature.

In the secondary combustion furnace 240, the combustible fraction remaining in the primary combustion gas is converted to liquified slag and combustion gas. The combustion gas thereby formed, mixed with the primary combustion gas, is exhausted via secondary combustion gas port 247 and is discharged into combustion gas cooling device 250 as secondary combustion gas. The slag, which exists as fine particles suspended in the secondary combustion gas, precipitates in the secondary combustion furnace 240 to thereby collect on the inclined floor 242A, after which it aggregates with the slag flow there from the slag separation chamber 230, and then flows downward accompanying the slag flow along the inclined surface as shown by the broken line and arrow $BB_5$ to the slag flow exit port 245, through which it is exhausted as shown by the broken line and arrow $BB_6$. In order to prevent the slag from adhering to the inclined floor 242A and remaining there, an auxiliary burner 246 is provided at the above-mentioned slag flow exit port 245 to heat the aggregated slag flow to an appropriate temperature.

In the combustion gas cooling device 250, low temperature gas is supplied via the low temperature gas supply pipe 253 as shown by solid line and arrow $BE_1$ to the low temperature gas introduction space 251*a* formed between cylindrical casing 251 and cylindrical duct 252 as described earlier, and thence to the central internal space 252*b* via the one or more openings 252*a* as shown by solid lines and arrows $BE_2$ (flowing in a generally opposite direction to the flow of secondary exhaust gas within the central internal space 252*b*), thereby cooling the central internal space 252*b* of combustion gas cooling device 250 to below the solidification temperature of the slag. Ideally, the cylindrical duct 252 should be cooled to a temperature at least 300° C. below the liquefaction point of the slag.

After entering the central internal space 252*b*, the low temperature gas immediately mixes with the secondary combustion gas entering the central internal space 252*b* via secondary combustion gas port 247. Thus mixed, the gas mixture is further cooled through contact with the internal surface of the cylindrical duct 252 which is constructed of material having good thermal conductivity.

By the above-described process, the minute particles of liquified slag suspended in the secondary combustion gas are rapidly cooled and thereby transformed to fly ash which does not significantly posses adherent properties. Thus the slag does not adhere to the internal wall of the cylindrical duct 252.

The combustion gas is thus cooled and the remaining slag contained therein converted to fly ash; the mixture is then exhausted via combustion gas exhaust port 254 and thereby discharged to heat recovery apparatus 260 as shown by the solid line and arrow $BA_6$. Passing through the heat recovery apparatus body 261, as shown by the solid line and arrow $BA_7$, the secondary combustion gas is then sent on to further processing equipment. As shown by the solid line and arrow $BF_1$ cooling air is supplied via air supply pipe 263 to the heat recovery apparatus body 261, which is then heated via countercurrent heat exchange by the hot secondary combustion gas and then discharged through exhaust pipe 264 as shown by the solid line and arrow $BF_2$.

In the combustion apparatus 10 shown in FIG. 1, the inner diameter of the combustion chamber 22 is 250 mm, the vertical axis of the combustion gas exhaust port is horizontally displaced 150 mm from the vertical axis of the combustion gas inlet 33, and the contact surface 32A presents an inclined planar face.

The inner diameter of the exhaust port 35 is 250 mm. The combustion gas cooling device 40 contains cylindrical casing 41 and one or more openings 252*a* having inner diameters of 600 mm and 60 mm respectively. The lengths of cylindrical casing 41 and cylindrical duct 42 are both 1400 mm.

The volume of combustion air supplied by air supply pipe 23 to combustion chamber 22 in the cyclone-type combustion furnace 20 is approximately 100–160N $m^3$/hour. The weight of dry sludge particles supplied to the particle supply pipe 24 is approximately 7–15 kg/hour. The flow speed of combustion gas exhausted from exhaust port 26 of the cyclone-type combustion furnace 20 is approximately 30–50 m/sec.

95–97% of ash components contained in dry sludge particles are expelled from slag outlet 36 from the slag separation chamber 30. At the time combustion gas is exhausted from exhaust port 35 of the slag separation chamber 30, the dust content by weight is approximately 0.3–0.7 g/$Nm_3$ dry gas base. The combustion gas exhausted from exhaust port 35 has a temperature of approximately 1350°–1450° C., and a flow volume of 500–900 $Nm^3$/hour.

In the combustion gas cooling device 40, the low temperature gas supply pipe 43 supplies low temperature air heated to 130°–200° C. at 70–90% humidity; low temperature gas is supplied at the rate of 500–800 $Nm^3$/hour.

The combustion gas from exhaust port 35 is mixed with low temperature gas and substantially cooled in the inner air space **42*b* of the cylindrical duct 42, and is exhausted from combustion gas exit duct 44. Residence time of combustion gas in the inner air space 42*b* of cylindrical duct 42 is approximately 0.15 seconds, and the temperature of the combustion gas at exit duct 44 is approximately 800°–850° C. At that time, the theoretical temperature of the inner circumferential surface of the cylindrical duct 42** is approximately 550° C.

Accumulating slag was not detected on the inner surface of the metal wall of cylindrical duct 42 in the combustion gas cooling device 40 after 200 hours of operation.

In order to provide a comparative example, the combustion gas cooling device 40 was removed, and the low temperature gas supply pipe was directly opened to the exhaust port 35, and the operation of the example was repeated.

As a result, on the exhaust port downstream of the opening of the low temperature gas supply pipe, slag accumulated. The accumulation of slag required the removal of the slag by using a scraping tool approximately once every 20 hours, thus producing an impediment to efficient operation of the combustion furnace.

Therefore, when examples of the present invention are compared to the above comparative example, it is clear that the accumulation of slag to the inner surface of exhaust port 35 is prevented. In other words, the present invention reduces the labor required for removing accumulated slag and can improve the efficiency of operation.

Again, as in the above case in which the liquefaction of gutter contaminants was explained, the present invention is not limited by the described apparatuses; for example, it is also possible to apply the present invention to the case in which the gas exhausted from a coal gas reaction furnace is to be cooled.

What is claimed is:

1. A combustion apparatus for burning or incinerating powdery materials to form liquid slag which is a fused and liquified state of the ash components of the powdery materials, and in the combustion apparatus, combustion gas and slag are introduced to slag separation chamber for separation of combustion gas and slag from each other, and combustion gas of the combustion apparatus is cooled by mixing of low temperature gas supplied at the outlet of combustion gas from the combustion apparatus, and the outlet of the combustion apparatus is furnished with the combustion gas cooling device which comprises:

(a) a casing of which one end opens to receive combustion gas and at least one opening is provided in the proximity of the distal end to receive low temperature gas;

(b) a duct made of material having good heat conductivity provided in the casing so that a space is formed between the duct and the casing as a pathway for low temperature gas and having one or more openings proximal to the combustion gas receiving end of the casing for introduction of low temperature gas into duct inside from the pathway;

(c) at least one outlet for mixture of combustion gas and low temperature gas from the gas-cooling device in the proximity of the opening for low temperature gas receiving.

2. A combustion gas cooling device according to claim 1 wherein the outer casing and the inner duct member are in cylindrical forms disposed coaxial.

3. A combustion gas cooling device according to claim 1 wherein the combustion apparatus is a cyclone-type furnace.

4. A combustion apparatus for incinerating combustible materials, the combustion apparatus comprising a combustion furnace and a combustion gas cooling device attached thereto, the combustion furnace comprising:

(a) a primary combustion means for effecting primary combustion of the combustible materials, provided with at least one inlet nozzle of combustible materials in granulated state and at least one inlet nozzle of combustion air arranged near the top end thereof so as to form a vortex flow of the materials to be incinerated;

(b) a secondary combustion means for accomplishing a complete incineration of combustible materials, and including a primary slag separation means for separating slag from combustion gas output from the primary combustion means, and the gas cooling device comprising:

(c) an outer casing provided with at least one first intake disposed in proximity to a distal end of the casing for introducing cooling gas from outside the casing into the casing;

(d) an inner duct member disposed in the outer casing and defining a pathway for the cooling gas between the inner duct member and the outer casing and defining a mixing space internal to the inner duct member, the inner duct member provided with at least one second intake disposed in proximity to a proximal end thereof for introducing cooling gas from the pathway for the cooling gas to the mixing space;

(e) at least one combustion gas introduction means for introducing combustion gas from the combustion furnace into the mixing space in proximity to the second intake; and (f) at least one combustion gas outlet for leading a mixture of the combustion gas and the cooling gas from in proximity to the distal end of the mixing space to outside of the combustion gas cooling device, whereby the inner duct member is cooled by the cooling gas passing through the pathway for the cooling gas, the combustion gas is rapidly mixed with and cooled by the cooling gas in the mixing space, and the slag dust contained in the combustion gas is rapidly solidifed so that the adhesion of the slag dust in the combustion gas cooling device is substantially diminished and is exhausted entrained by the combustion gas from the cooling device.

5. A combustion apparatus according to claim 4 wherein the gas cooling device is connected to the secondary combustion means.

6. A combustion apparatus according to claim 5 wherein the secondary combustion means comprises a secondary combustion chamber for effecting secondary combustion, the secondary combustion chamber receiving the combustion gas from the primary slag separation means and at least one secondary combustion air intake is provided for supplying air for secondary combustion to the secondary combustion chamber.

7. A combustion apparatus according to claim 6 wherein the primary slag separation means comprises a slag separation chamber and its floor, so that the combustion gas output from the primary combustion means is blown onto the floor for separating the slag from the combustion gas, and a combustion air is introduced into the primary slag separation means so that a mixture of the combustion air and the combustion gas is introduced to the secondary combustion chamber communicating to the primary slag separation means.

8. A combustion apparatus according to claim 7 wherein the secondary combustion chamber is provided with a means for heating a floor thereof for melting the slag accumulated on the floor, and a gutter for gathering the slag.

9. A combustion apparatus according to claim 8 wherein the combustion gas cooling devise is attached to an upper part of the secondary combustion chamber.

10. A combustion apparatus according to claim 4, wherein the inner duct member is made of metal.

11. A combustion apparatus according to claim 4, wherein an inner diameter of the inner duct member is larger than that of the combustion gas inlet to the casing.

12. A combustion apparatus according to claim 4 wherein sewage sluge is incinerated in the combustion furnace.

13. A combustion apparatus according to claim 4, wherein the temperature of combustion gas to be introduced in the cooling device is 1300°-1500° C.

14. A combustion apparatus according to claim 4, wherein the temperature of the cooling gas to be introduced to the first intake of the outer casing is 150°-250° C.

15. A combustion apparatus according to claim 4, wherein the combustion gas is cooled to below 1000° C. in the cooling device.

16. A combustion gas cooling device for cooling combustion gas discharged from a combustion furnace, the combustion gas containing slag dust, the combustion gas cooling device comprising:

(a) an outer casing provided with at least one first cooling air intake disposed in proximity to a distal end of the casing for introducing cooling gas from outside the casing into the casing;

(b) an inner duct member disposed in the outer casing and defining a pathway for the cooling gas between the inner duct member and the outer casing and defining a mixing space internal to the inner duct member, the inner duct member provided with at least one second intake disposed in proximity to a proximal end thereof for introducing cooling gas from the pathway for the cooling gas to the mixing space;

(c) at least one combustion gas introduction means for introducing combustion gas from the combustion furnace into the mixing space in proximity to the second intake; and (d) at least one combustion gas outlet for leading a mixture of the combustion gas and the cooling gas from in proximity to the distal end of the mixing space to outside of the combustion gas cooling device, whereby the inner duct member is cooled by the cooling gas passing through the pathway for the cooling gas, the combustion gas is rapidly mixed with and cooled by the cooling gas in the mixing space, and the slag dust contained in the combustion gas is rapidly cooled so that the adhesion of the slag in the combustion gas cooling device is substantially diminished and is exhausted entrained by the combustion gas from the cooling device.

17. A combustion gas cooling device according to claim 16 wherein the outer casing and the inner duct member are in cylindrical forms disposed coaxial, the inner duct member disposed internal to the outer casing.

18. A combustion gas cooling device according to claim 16 wherein the combustion furnace is a cyclone-type furnace.

* * * * *

UNITED STATES PATENT AND TRADEMARK OFFICE

CERTIFICATE OF CORRECTION

PATENT NO. : 5,000,098

DATED : March 19, 1991

INVENTOR(S) : Shiro Ikeda, et al.

It is certified that error appears in the above-identified patent and that said Letters Patent is hereby corrected as shown below:

Column 13, line 6: "0.3-0.7 g/$Nm_3$" should read as --0.3-0.7 g/$Nm^3$--

Signed and Sealed this

First Day of March, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,000,098

DATED : March 19, 1991

INVENTOR(S) : Shiro Ikeda, et al.

It is certified that error appears in the above-indentified patent and that said Letters Patent is hereby corrected as shown below:

On The Title Page Item [30], delete second occurrence of --Jan. 22, 1990 [JP] Japan.....2-12026--

Signed and Sealed this

Twenty-seventh Day of September, 1994

*Attest:*

*Attesting Officer*

Bruce Lehman

BRUCE LEHMAN

*Commissioner of Patents and Trademarks*